US005259785A

United States Patent [19]

Inaba et al.

[11] Patent Number: 5,259,785

[45] Date of Patent: Nov. 9, 1993

[54] WIRE COVER FOR A CONNECTOR

[75] Inventors: Shigemitsu Inaba; Masayuki Yamamoto, both of Shizuoka, Japan

[73] Assignee: Yazaki Corporation, Japan

[21] Appl. No.: 21,599

[22] Filed: Feb. 24, 1993

[30] Foreign Application Priority Data

Feb. 27, 1992 [JP] Japan ..... 4-009178[U]

[51] Int. Cl.[5] ..... H01R 13/58

[52] U.S. Cl. ..... 439/466; 439/364

[58] Field of Search ..... 439/466, 468, 473, 364, 439/456, 459

[56] References Cited

FOREIGN PATENT DOCUMENTS 62-160471 10/1987 Japan .

*Primary Examiner*—Gary F. Paumen

*Attorney, Agent, or Firm*—Wigman, Cohen, Leitner & Myers

[57] ABSTRACT

A wire cover is for use in guiding and collecting a plurality of wires at one end thereof. The plurality of wires extend from a second connector connected to a first connector. The second connector is connected to the first connector through a clamping bolt. The second connector has a pillar-like supporting member where the clamping bolt is threadedly mounted. The wire cover has a base and a pair of side walls extending from the base. Engaging members are formed on the side walls for engaging with the second connector. A projecting wall is projected from the base. The projecting wall has a body portion and a tip portion. The body portion is larger in width than the pillar-like supporting member. The tip portion is tapered in shape.

5 Claims, 4 Drawing Sheets

WIRE COVER FOR A CONNECTOR

BACKGROUND OF THE INVENTION

This invention relates to a wire cover for a connector for guiding a plurality of electric wires connected to the connector in a predetermined direction to collect these wires together.

Typical of such wire cover for a connector is described in Japanese Utility Modes Laid Open No. 160471/1987, which will be described below with reference to FIG. 1.

A male connector 10 has a housing body 11 where a plurality of female terminals 12 are secured. Each of the female terminals 12 faces to the front portion of an opening 13. An electric wire 14 is connected to the rear end of each female terminal 12. The electric wire 14 is wired through the tailing portion of the opening 13.

A pillar-like supporting member 15 is projected backward from the center of the housing body 11 of the male connector 10. A bolt hole 15*a* for a clamping bolt is penetrated through the pillar-like supporting member 15. A clamping bolt 1 is threaded into this bolt hole 15*a* from the rear end thereof. In addition, a predetermined number of engaging projections 16 and 17 are projected from the outer surface of the housing body 11. The engaging projections 16 and 17 are apart from each other to mount a wire cover 30 which will be described below.

A female connector 20 has a housing body 21 where a plurality of male terminals 22 are secured. Each of the male terminals 22 faces to the front portion of an opening 23.

A supporting member 24 is secured to the center of the housing body 21 of the male connector 20. A screw 24*a* of a predetermined depth is provided from the rear surface of the supporting member 24.

The wire cover 30 is formed like a tub with the openings at both ends. In other words, the wire cover 30 has no lateral side walls. In addition, the longitudinal sides of the wire cover 30 (the upper and lower portion in FIG. 1) are provided with engaging holes 33 and 34. The engaging holes 33 and 34 engage with the engaging projections 16 and 17 of the male connector 10, respectively. An operating hole 35 is opened through the bottom surface of the cover 30. The operating hole 35 receives the pillar-like supporting member 15 of the male connector 10.

In order to assemble the male and female connectors 10 and 20 with the wire cover 30, the housing body 11 of the male connector 10 is first abutted to the housing body 21 of the female connector 20. The clamping bolt 1 is inserted into the bolt hole 15*a* of the pillar-like supporting member 15 projected from the male connector 10. The clamping bolt 1 is then threadedly mounted on the screw 24*a* of the female connector 24. As a result, the male terminal 22 engages with the female terminal 12. In this manner, the housing body 11 of the male connector 10 engages with and secured to the housing body 21 of the female connector 20.

Subsequently, the pillar-like supporting member 15 of the male connector 10 is inserted into the operating hole 35 of the wire cover 30. The cover 30 is mounted on the connector by means of engaging the engaging holes 33 and 34 thereof with the engaging projections 16 and 17 of the male connector 10, respectively.

A plurality of electric wires 14 extending from the male connector, however, may lie on the side of the pillar-like supporting member 15 when these electric wires 14 should be wired to the opening at the one end of the cover 30. In this state, the application of the cover 30 may results in the wires pinched between the pillar-like supporting member 15 and the operating hole 35. Thus, the above mentioned structure is disadvantageous in that it may cause a damage of the wires.

SUMMARY OF THE INVENTION

An object of the present invention is to provide a wire cover for a connector which can be readily mounted to the connector without pinching the wires between the pillar-like supporting member and the operating hole.

In order to achieve the above mentioned object, the present invention provides a wire cover for a connector for collecting a plurality of electric wires extending from a second connector connected to a first connector, the second connetor connected to the first connector through a clamping bolt and having a pillar-like supporting member where the clamping bolt is threadedly mounted, the wire cover comprising a base for guiding the electric wires; a pair of side walls for guiding and collecting the electric wires, the side walls extending from the base; engaging members formed on the side walls for engaging with the second connector; and a projecting wall projecting from the base, the projecting wall including a body portion which is larger in width than the pillar-like supporting member and a tip portion of a tapered shape.

When the electric wires to be collected are wired from the wire-connection of the connector passing on the side of the pillar-like supporting member of the connector, the wire cover is mounted on the connector pushing the wires away from the side of the pillar-like supporting member. More particularly, the tapered surface of the projecting wall of the cover makes the wires to move in the direction normal to the wiring. In this event, the tapered surface contacts the wires to push them away from the side of the pillar-like supporting member.

BRIEF DESCRIPTION OF THE INVENTION

DESCRIPTION OF THE PREFERRED EMBODIMENT

Figure 1:
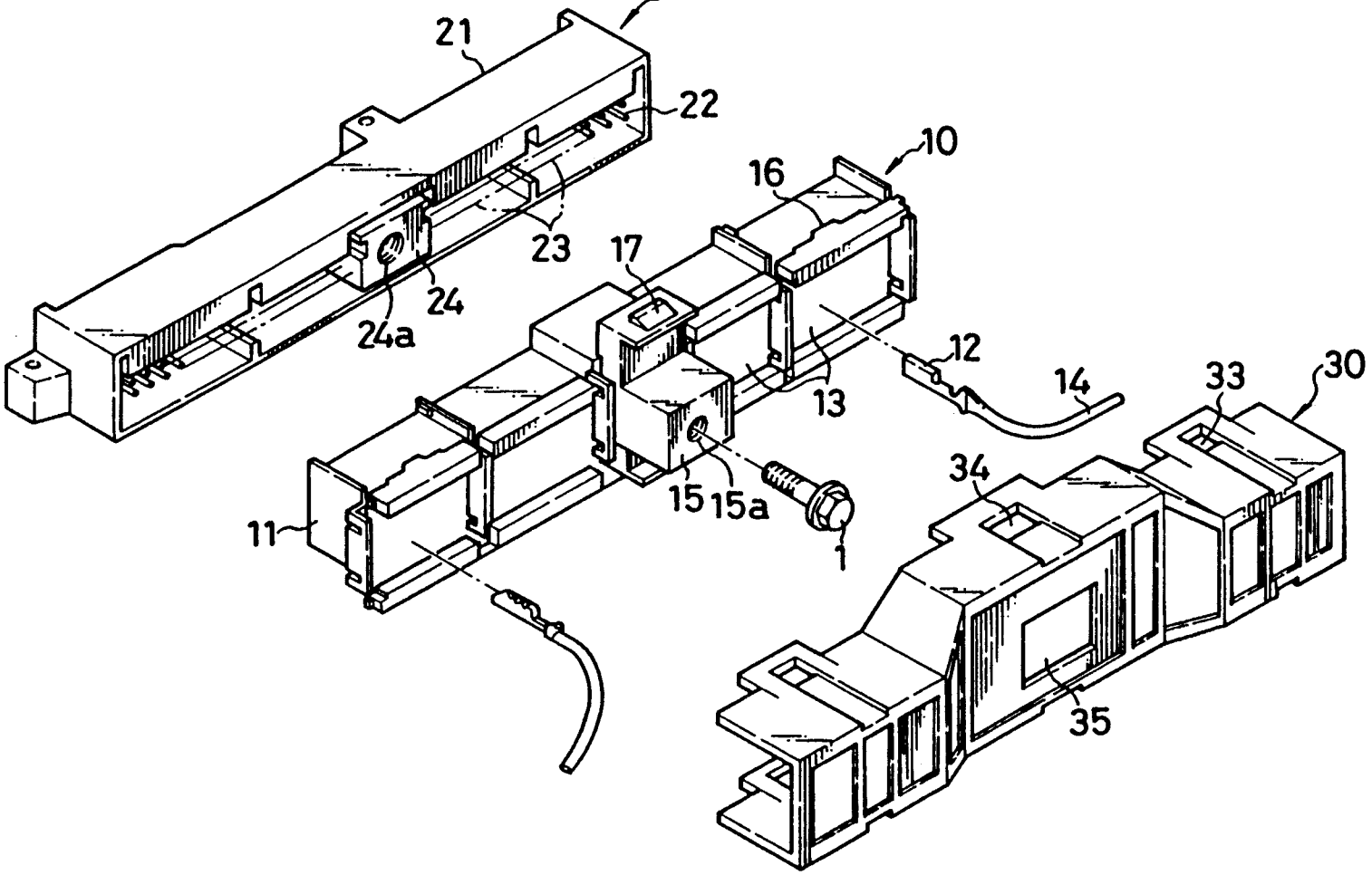
FIG. 1 PRIOR ART
FIG. 1 is a perspective view of a conventional wire cover for a connector, in which the wire cover is removed from the connector.
Figure 2:
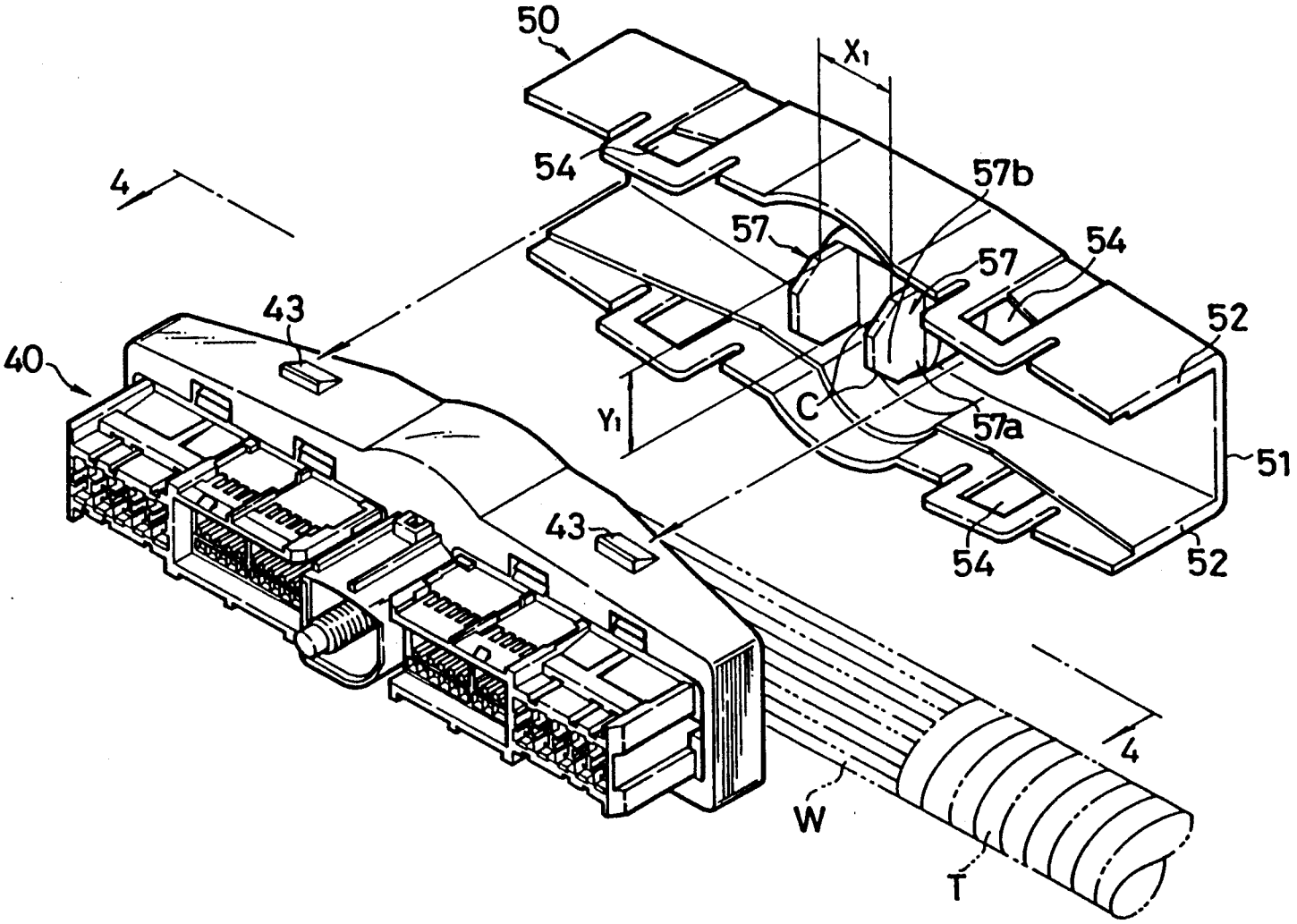
FIG. 2 is a perspective view of a wire cover for a connector according to an embodiment of the present invention, in which the wire cover is removed from the connector.
Figure 3:
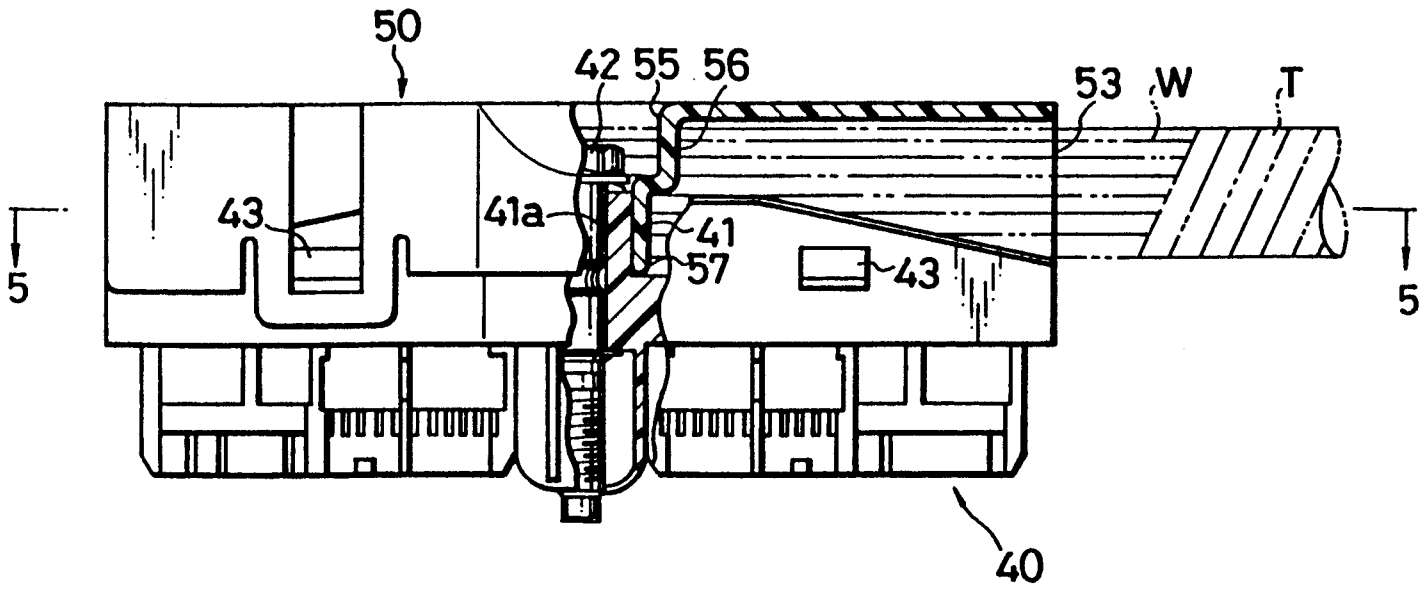
FIG. 3 is a partial cutaway view in side of the wire cover illustrated in FIG. 2, in which the wire cover is mounted on the connector.

An embodiment of the present invention will be described below with reference to the drawings.

FIGS. 2 through 5 show the embodiment of a wire cover for a connector according to the present invention. A plurality of terminals (not shown) are secured to the inside of a connector 40. Each of the terminals is arranged in such a manner that it faces to the rear end of the connector 40. In addition, each terminal is connected to one of a plurality of electric wires W at the rear portion of the connector 40. The wires W are wired therefrom to the back of the connector 40.

A pillar-like supporting member 41 is secured to the center of the rear portion of the connector 40. The pillar-like supporting member 41 is projected therefrom towards the back of the connector 40. A bolt hole 41*a* penetrates through the pillar-like supporting member 41. The male and female connectors 40 can be connected by means of screwing with a clamping bolt 42 through the bolt hole 41*a*.

In addition, a plurality of engaging projections 43 are projected from the outer surface of the connector 40. The engaging projections 43 are spaced apart from each other at a predetermined distance.

A wire cover 50 is formed like a tub with a pair of side walls 52 on both sides of a bottom wall 51. The wire cover 50 has opening portions 53 at both ends thereof where the wires received therein are collected and wired.

Each of the side walls 52 is provided with a plurality of engaging holes 54 spaced apart with each other at a predetermined distance. The engaging holes 54 engage with the engaging projections, respectively, of the connector 40 when the wire cover 50 is mounted on the connector 40.

An operating hole 55 is opened at the center of the wire cover 50 to inspect the clamping bolt 42 of the male and female connectors 40. A circular projection 56 is projected from the inner surface of the bottom wall 51 along the edge of the operating hole 55. In other words, the circular projection 56 is integrally formed with the bottom wall 51 such that it extends in the direction parallel to the side walls 52. One end of the circular projection 56 away from the bottom wall 51 is inwardly turned and projected at a predetermined length to form a rectangular opening. A pair of projecting walls 57 is projected from the opposite sides of the rectangular opening which are normal to the wiring direction of the wires W, namely, normal to the side walls 52. More particularly, the projecting walls 57 are projected in the direction parallel to the circular projection 56. As described below, the pillar-like supporting member 41 is inserted in the rectangular opening when the wire cover 50 is mounted on the connector 40. The distance X1 (FIG. 2) between the projecting walls 57 is slightly larger than the width X2 (FIG. 5) of the pillar-like supporting member 41. Thus, the projecting walls 57 face to the side walls of the pillar-like supporting member 41 when the wire cover 50 is mounted on the connector 40 with a distance therebetween. Each of the projecting walls 57 has a body portion 57*a* and a tip portion 57*b*. The distance Y1 (FIG. 2) between the body portions 57*a* is slightly larger than the width Y2 (FIG. 5) perpendicular to the width X2. Each of the tip portions 57*b* has tapered surfaces C. The tapered surface C is formed by cutting away both corners of the tip portion 57*b*. Thus, the width of the projecting wall 57 is gradually reduced towards the extremity.

The above mentioned structure makes it possible to mount the wire cover 50 on the connector with the engaging holes 54 of the wire cover 50 engaged with the respective engaging projections 44 of the connector 40 while the pillar-like supporting member 41 being inserted between the projecting walls 57.

Next, the present invention will be described below regarding to the operation to mount the wire cover 50 on the connector 40 where the wires W are connected.

Figure 4:
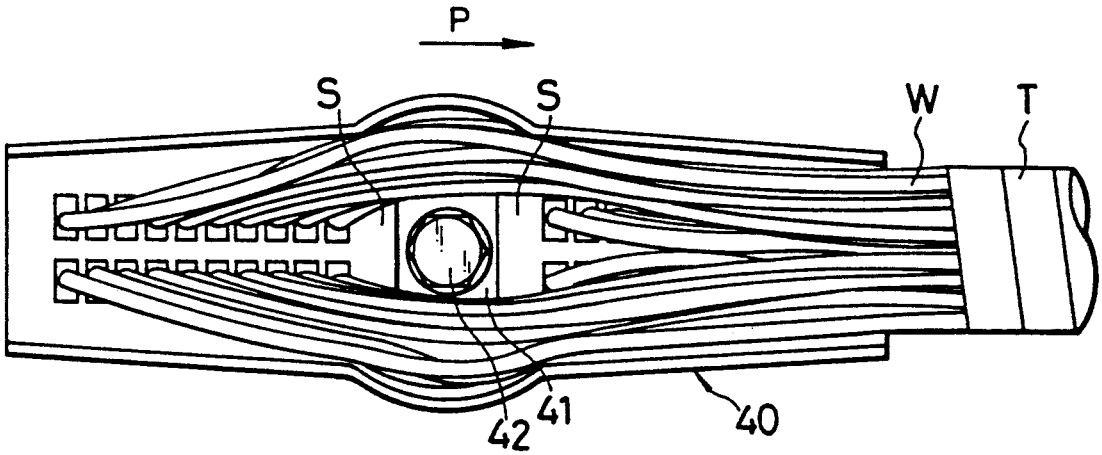
FIG. 4 is a plan view taken on line 4—4 of FIG. 2, showing electric wires connected to the connector being collected at one end thereof in a predetermined direction.
Figure 5:
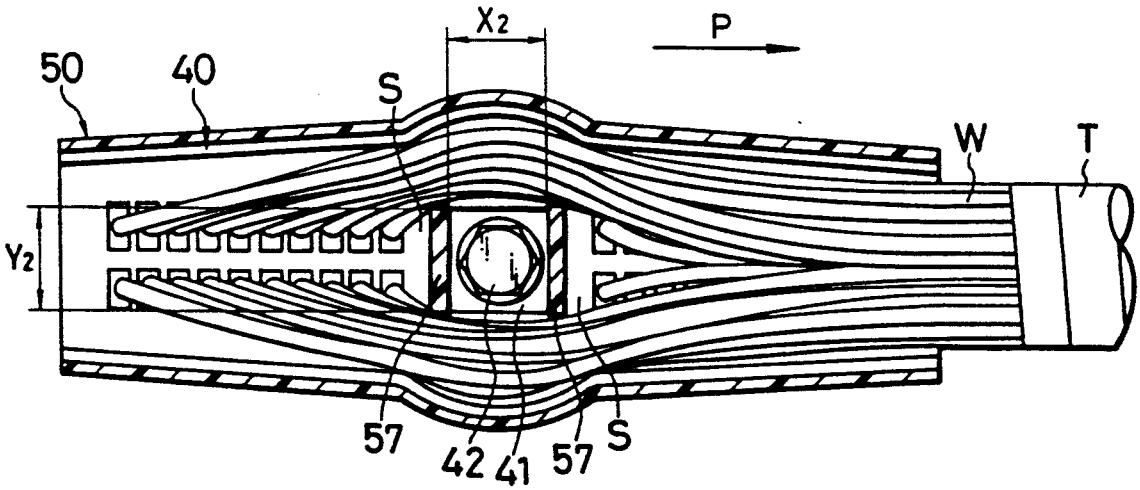
FIG. 5 is a sectional view taken on line 5—5 of FIG. 3, showing electric wires connected to the connector being collected at one end thereof in a predetermined direction.

As shown in FIG. 4, a plurality of electric wires W extending towards the back of the connector 40 are guided along the walls of the connector 40 to a predetermined direction. In this event, the wires W are guided along the inner surface of the connector and collected at one end thereof. The wires W may be wrapped together by using a tape T at the outside of the connector 40.

The wires W are wired passing on the surface of the pillar-like supporting member 41 where the bolt hole 41*a* is opened. When the wires W are collected at one end of the connector 40, spaces S are formed near the sides of the pillar-like supporting member 41 perpendicular to the wiring direction P of the wires W. As described below, the present invention enables the removal of the wires partially covering the pillar-like supporting member 41 from the surface thereof when the wire cover 50 is mounted on the connector 40. The wires may be wired without passing on the surface of the pillar-like supporting member 41. However, such a case may cause no wire-damage problem, of which description will be omitted here.

The wire cover 50 is urged to the connector 40 when being mounted thereon. In this event, the pillar-like supporting member 41 is interposed between the projecting walls 57 projecting in the direction normal to the wiring direction P of the wire W. The tip portions 57*b* of the pair of projecting walls 57 can be inserted into the spaces S near the sides of the pillar-like supporting member 41. As the wire cover 50 approaches to the connector 40, the tapered surfaces C of the projecting walls 57 pushes the wire W away. More particularly, the tapered surfaces C move the wires W in the direction perpendicular to the wiring direction P of the wire W while slidably contacting with the wires. When the wire cover 50 is completely mounted on the connector 40, the wires W reaches to the body portion 57*a* of the projecting wall 57. As described above, the width Y1 of the body portion 57*a* is slightly larger than the width Y2 of the pillar-like supporting member 41. Accordingly, the wires W can be positively removed from the surface of the pillar-like supporting member 41. Thus, the wire cover 50 can be readily mounted on the connector 40 without pinching the wires W between the operating hole 55 of the wire cover 50 and the pillar-like supporting member 41 of the connector 40.

While the above mentioned description has thus been described in conjunction with the projecting walls 57 having the tapered surfaces, it may be possible to form the projecting walls with the curved tip portion.

What is claimed is:

1. A wire cover for a connector for collecting a plurality of electric wires extending from a second connector connected to a first connector, said second connector connected to said first connector through a clamping bolt and having a pillar-like supporting member where said clamping bolt is threadedly mounted, said wire cover comprising:

a base for guiding said electric wires;

a pair of side walls for guiding and collecting said electric wires, said side walls extending from said base;

engaging members formed on said side walls for engaging with said second connector; and a projecting wall projecting from said base, said projecting wall including a body portion which is larger in width than said pillar-like supporting member and a tip portion of a tapered shape, said projecting wall separating said wires from said pillar-like supporting member.

2. A wire cover as claimed in claim 1, including a pair of said projecting walls, said projecting walls being arranged on both sides of said pillar-like supporting member.

3. A wire cover as claimed in claim 2, wherein said projecting walls are arranged with a distance therebetween which is slightly larger than a width of said pillar-like supporting member.

4. A wire cover as claimed in claim 1, wherein said tip portion of said projecting wall has a pair of tapered surfaces.

5. A wire cover as claimed in claim 1, wherein each said engaging member has an engaging hole.

* * * * *